US005253501A

United States Patent [19]

Spath

[11] Patent Number: 5,253,501

[45] Date of Patent: Oct. 19, 1993

[54] MECHANISM AND METHOD FOR BENDING SHEET METAL

[76] Inventor: Walter E. Spath, Hardstrasse 8, D-7705 Steisslinger, Fed. Rep. of Germany

[21] Appl. No.: 783,988

[22] Filed: Oct. 29, 1991

Related U.S. Application Data

[63] Continuation-in-part of Ser. No. 174,248, Mar. 28, 1988, abandoned.

[30] Foreign Application Priority Data

Apr. 1, 1987 [DE] Fed. Rep. of Germany ..... 3710931
Nov. 17, 1987 [DE] Fed. Rep. of Germany ..... 3738566

[51] Int. Cl.[5] ..... B21D 5/14; B21B 1/08

[52] U.S. Cl. ..... 72/167; 72/177; 72/224

[58] Field of Search ..... 72/167, 177, 178, 182, 72/173, 170, 224

[56] References Cited

U.S. PATENT DOCUMENTS

| | | | |
|---|---|---|---|
| 93,181 | 8/1869 | Cushing | 72/168 |
| 1,002,907 | 9/1911 | Dunn | 72/224 |
| 2,505,241 | 4/1950 | Gray | 72/224 |
| 3,248,198 | 4/1966 | Jamnik | 72/224 |
| 3,339,392 | 9/1967 | Buckwalter | 72/224 |
| 4,660,399 | 4/1987 | Suter | 72/181 |
| 4,716,754 | 1/1988 | Youngs | 72/181 |

FOREIGN PATENT DOCUMENTS

| | | | |
|---|---|---|---|
| 115331 | 6/1985 | Japan | 72/167 |
| 122009 | 1/1959 | U.S.S.R. | 72/167 |
| 624169 | 5/1949 | United Kingdom | 72/167 |

*Primary Examiner*—Daniel C. Crane
*Attorney, Agent, or Firm*—Paul H. Gallagher

[57] ABSTRACT

Bending preshaped sheet metal pieces that have a web and side flanges, by stretching on one side, and compressing on the other side, by utilizing opposed rollers. They can be, and are, selectively bent into cylinder shapes or cone shapes. The bending steps produce folds in the extended edges of the flanges, of circular cross sectional shape, and in one form, are of large dimensions on one side and of small dimensions on the other side, and adjacent pieces are interconnected by placing the large fold of one piece over and encompassing the small fold of the other piece, to form lids of great area.

16 Claims, 12 Drawing Sheets

Fig. 1b
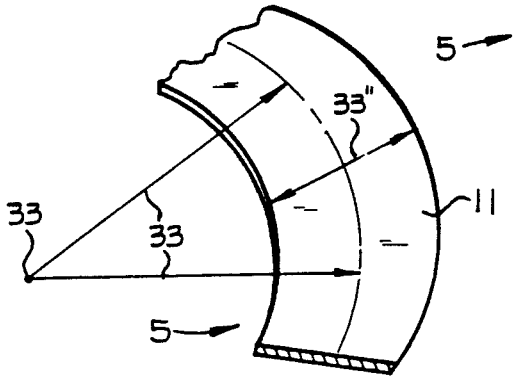
Fig. 1a
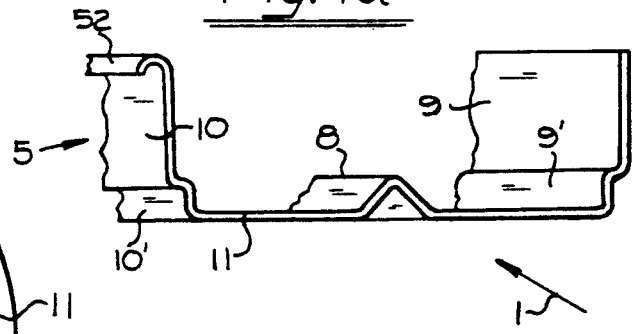
Fig. 1c
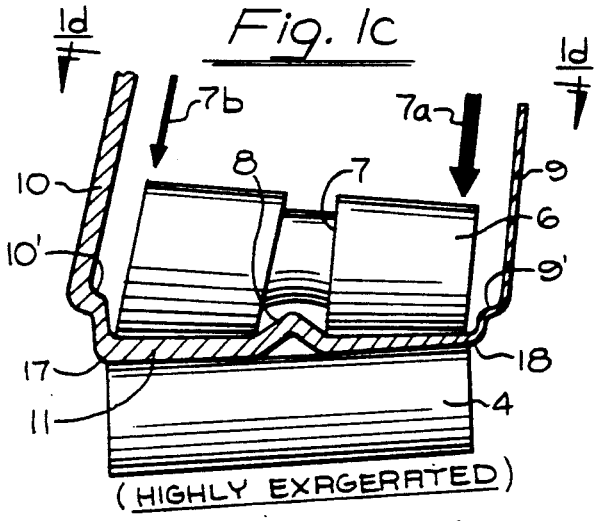
Fig. 1d
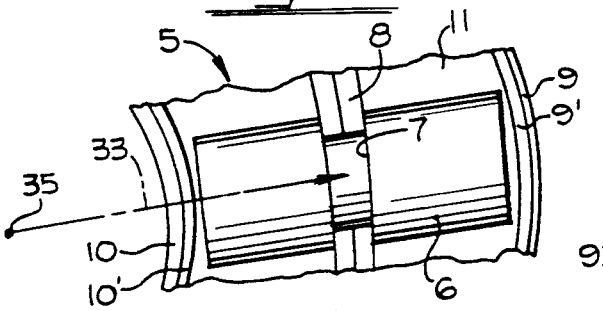
Fig. 4a
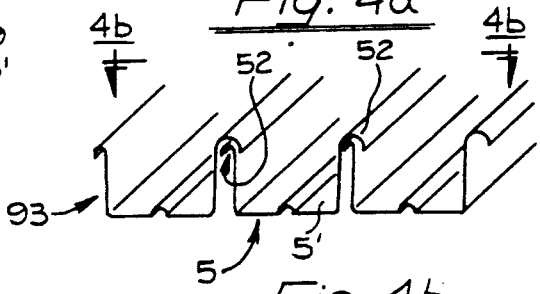
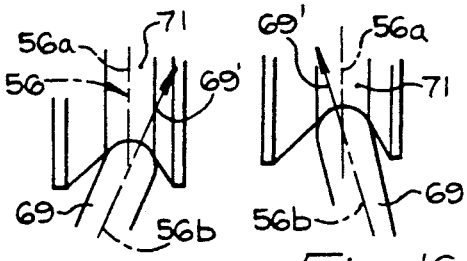
Fig. 16a Fig. 16b
Fig. 4b
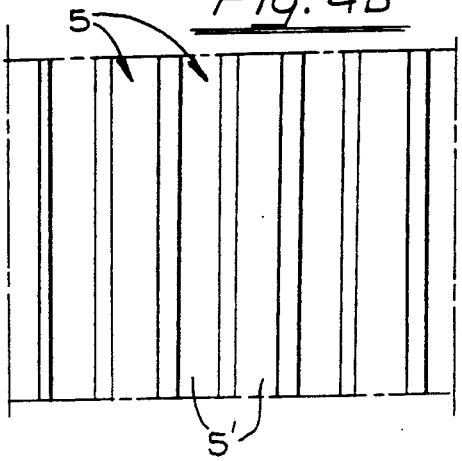
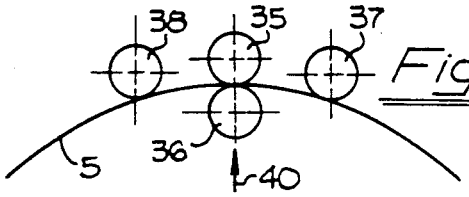
Fig. 5a

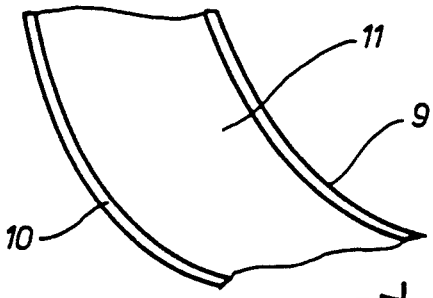
FIG 10b
FIG 10
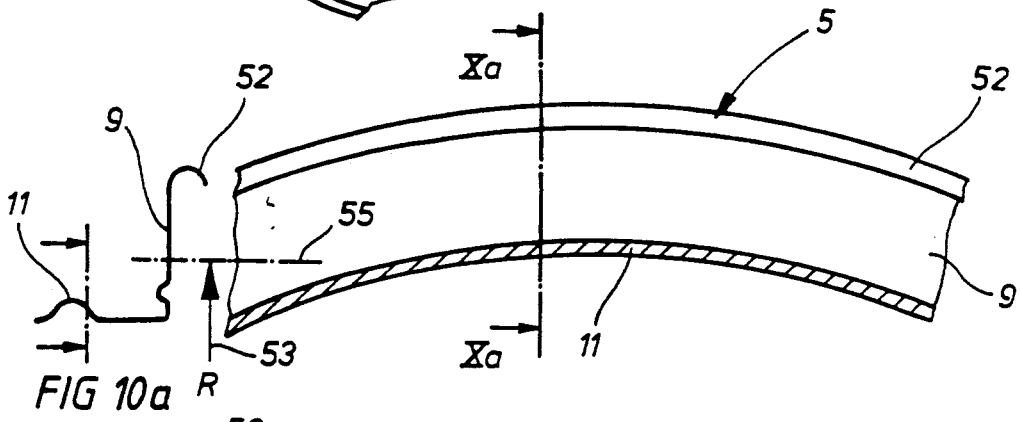
FIG 10a
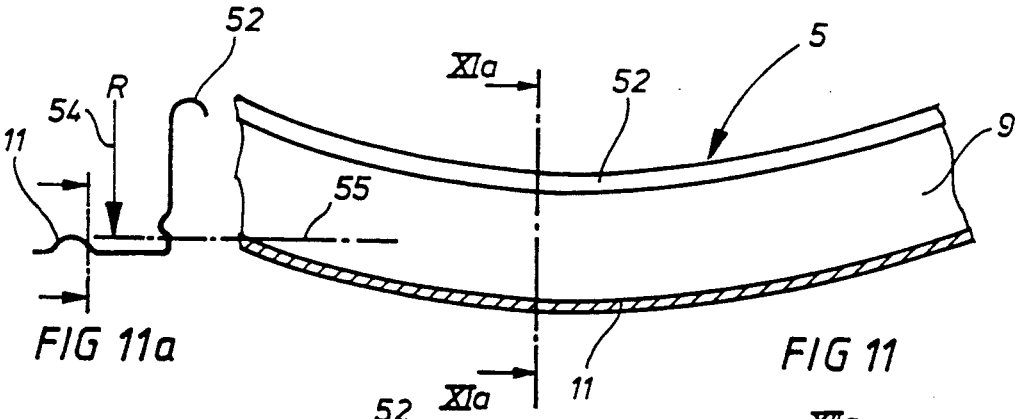
FIG 11a
FIG 11
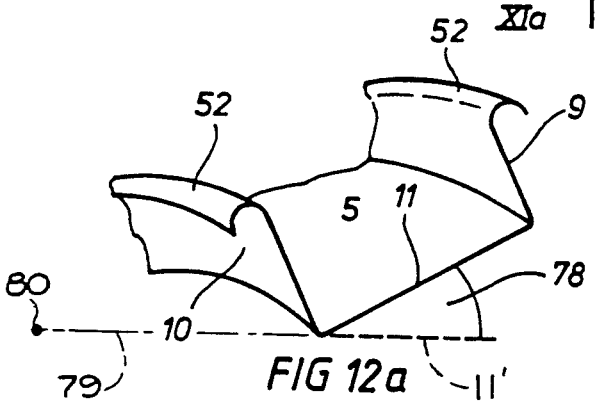
FIG 12a
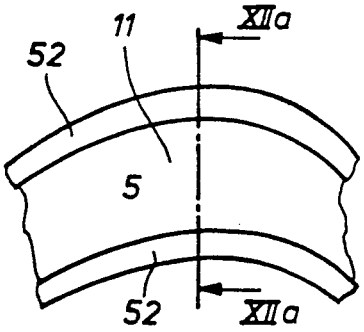
FIG 12

MECHANISM AND METHOD FOR BENDING SHEET METAL

This application is a continuation-in-part of application Ser. No. 174,248, now abandoned.

BRIEF SUMMARY OF THE INVENTION

The invention resides in the broad field of bending sheet metal.

Sheet metal, by definition, has a great width relative to its thickness, and a main feature of the invention is bending such sheet metal on a radius extending in the direction of the width of the sheet.

The bending of the metal involves thinning and stretching at different locations in the metal according to the direction of bending. The thinning and stretching is produced by applying great pressure, and the bending is produced by greater pressure at one location than another.

The apparatus of the invention is well adapted to and effective for bending sheet metal of contours, profiles or shapes as distinguished from pieces that are only flat.

More specifically the invention is well adapted to such profiles as channels that include webs and flanges or elements, and the individual elements include conformations such as beads, folds and curves.

BRIEF DESCRIPTION OF THE SEVERAL VIEWS OF THE DRAWINGS

FIG. 1*a* is a fragmentary perspective view of the channel shown in FIG. 1.

FIG. 1*b* is a diagrammatic top view of a portion of the channel.

FIG. 1*c* is a view oriented according to FIG. 1 indicating certain forces applied.

FIG. 1*d* is a top view taken at line 1*d*—1*d* of FIG. 1*c*.

FIG. 4*a* is a fragmentary perspective view of a plurality of channel pieces converted together to form a cover.

FIG. 4*b* is a top view taken at line 4*b*—4*b* of FIG. 4*a*.

FIG. 5*a* is a view similar to FIG. 5 but with certain elements in relatively reversed position.

FIG. 10 is a diagrammatic view, partially in section, of the channel in a curved shape.

FIG. 10*a* is a partial view, taken at line X*a*—X*a* of FIG. 10.

FIG. 10*b* is a top view of a fragment of a channel, bent according to FIG. 10.

FIG. 11 is a view similar to FIG. 10 but showing the channel or article in convex shape rather than concave.

FIG. 11*a* is a fragmentary view taken at line XI*a*—XI*a* of FIG. 11.

FIG. 12 is a fragmentary view of a channel or article circularly bent as well as convex curved, and additionally conically bent.

FIG. 12*a* is a fragmentary perspective view oriented according to line XII*a*—XII*a* of FIG. 12.

FIG. 16*a* is a fragmentary view of the elements included in the rectangle 16*a* of FIG. 16, but with relative positions.

FIG. 16*b* is a view similar to FIG. 16*a* but with elements in different position.

DETAILED DESCRIPTION

Figure 15:
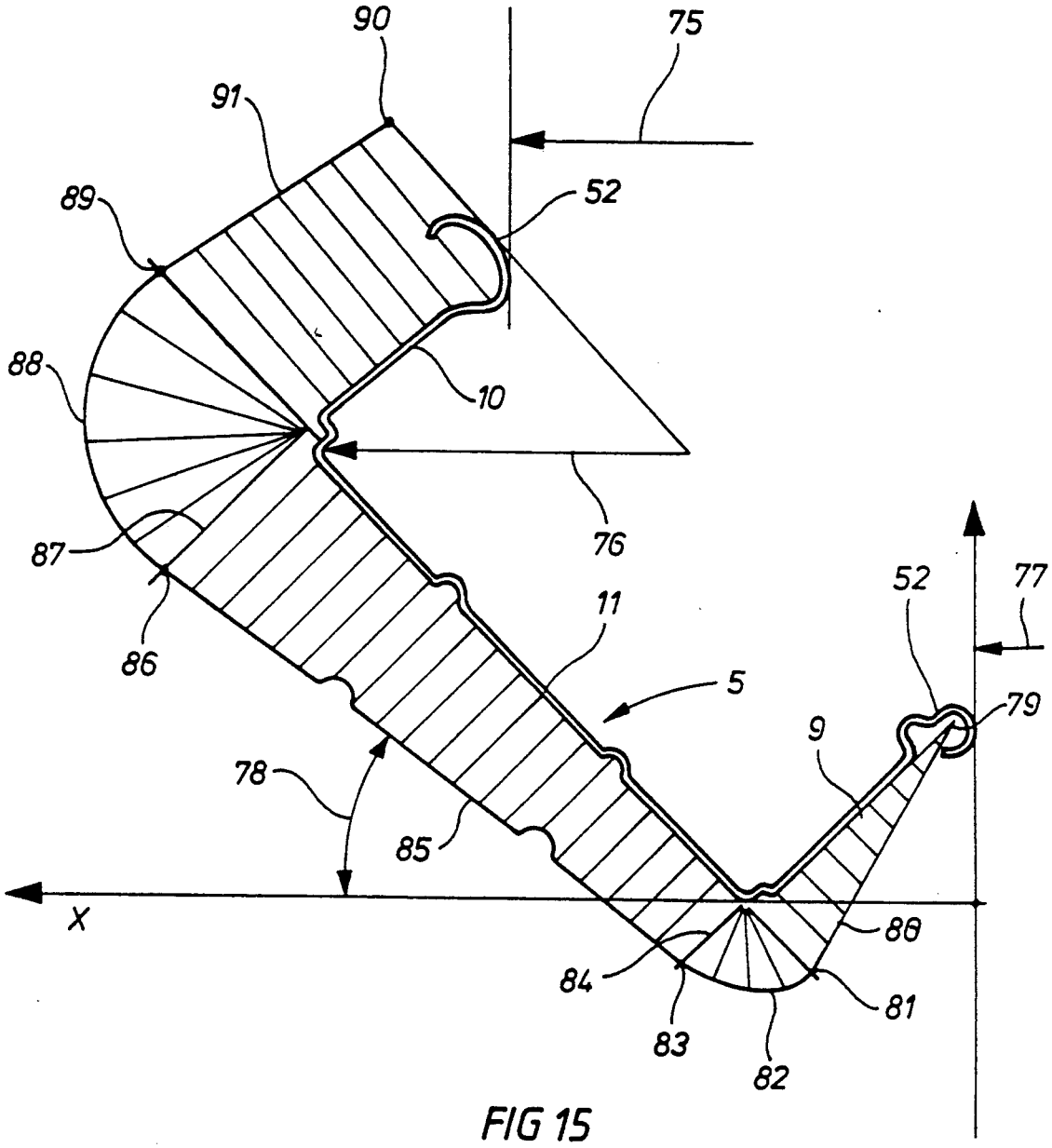
FIG. 15 is a transverse view of the channel, with representation of bending forces to produce a conically bent channel, constituting a re-forming of a contoured channel represented in FIG. 10 or FIG. 11.
Figure 16:
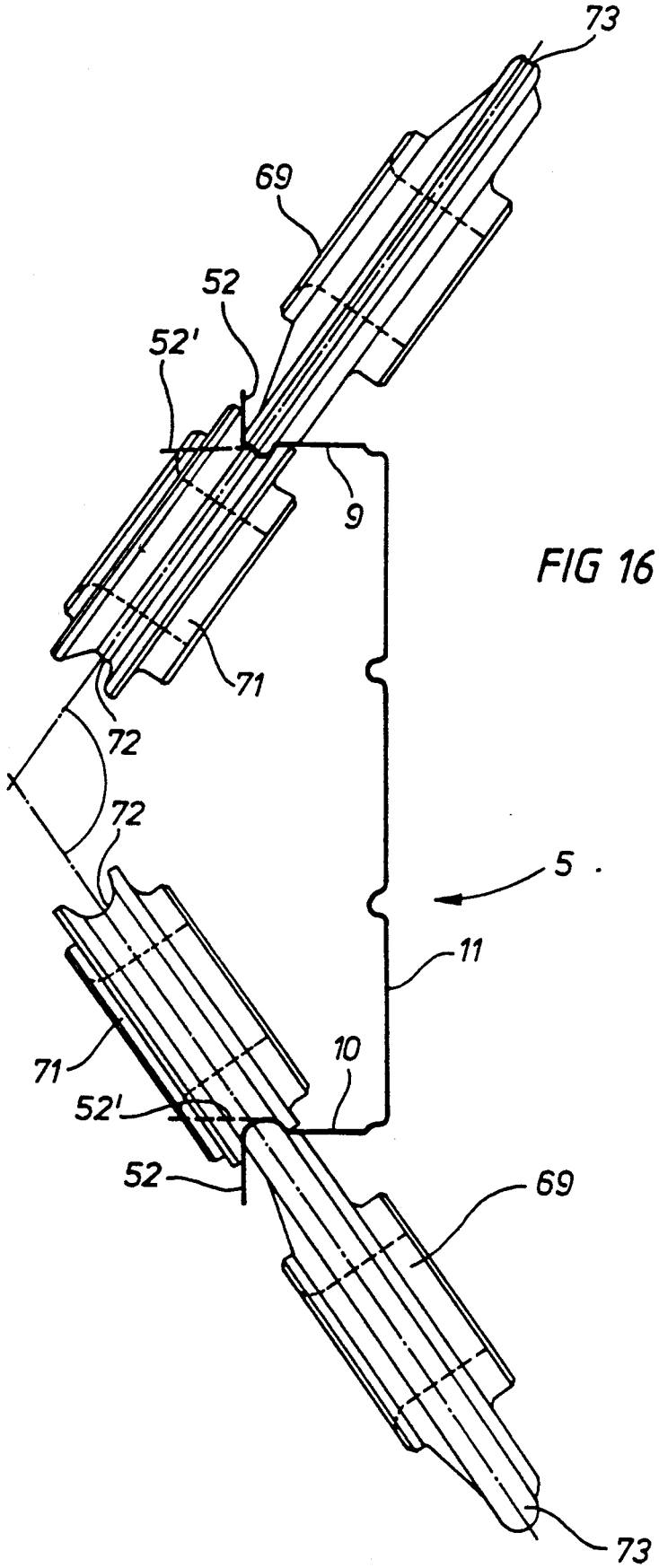
FIG. 16 shows roller pairs for re-forming folds.
Figure 17:
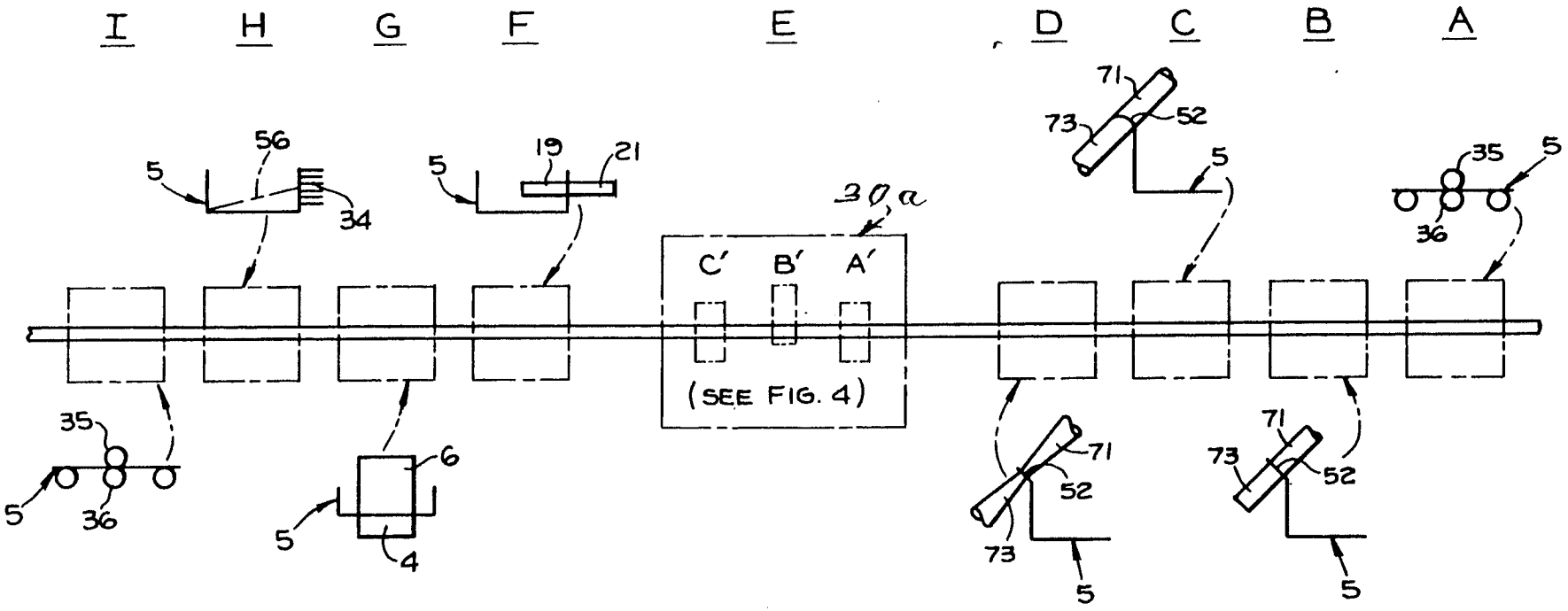
FIG. 17 is a diagrammatic illustration of mechanical components referred to in the description of the apparatus.

The disclosure in the drawings is presented in four main phases, first, that of FIGS. 1, 13–16; second, that of FIGS. 2–7; third, that of FIGS. 7–12*a*; and fourth, that of FIG. 17.

The first phase includes the forces utilized, both in direction and magnitude, as applied in producing the shapes desired; the second includes the mechanical means, such as rollers and pressure means; the third includes the shapes themselves that are produced; and the fourth includes a succession or series of components of the apparatus and their interrelationship. These components will be referred to elsewhere in the description. Certain of the components will be described in detail, and others may be of known kind and hence not described in detail, but are referred to in their cooperation in the functioning of all the components.

Figure 1:
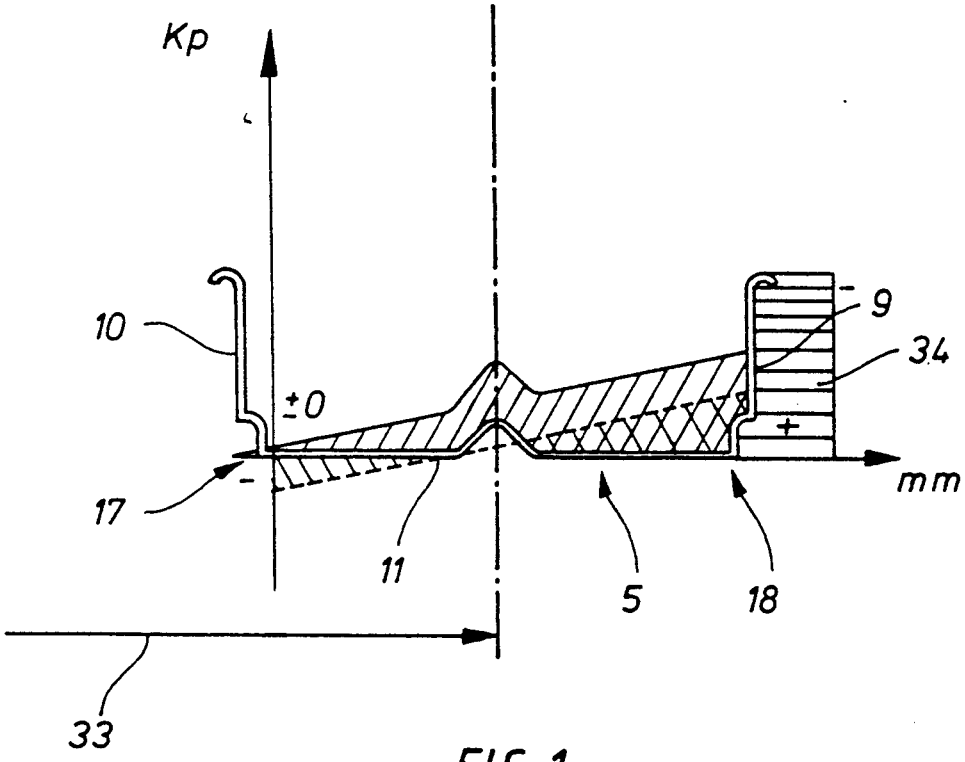
FIG. 1 is a cross section of a contoured sheet metal, or channel, with representation of tension fields.

FIG. 1 shows an article 5, to be bent or curved, and is in the form of a channel having a web 11 and flanges 9, 10 constituting flanking elements. Reference is made to FIGS. 1*a*–1*d*, showing various aspects of the channel 5 of FIG. 1, for convenience in consideration of the elements involved and the steps of the process involving these elements. FIG. 1*a* shows the end of the channel 5 presented in FIG. 1, and a certain depth thereof, extending longitudinally of the channel. FIG. 1 is oriented according to the arrow 1 of FIG. 1*a*. FIG. 1*b* shows a fragment of the web only of the channel, to present the feature of the direction of bending of the metal. The web 11 is basically a flat piece, although it may assume inclined curving as described below, but the essential feature is that the channel is bent in direction indicated by the radius 33 about an axis 33'. The web of course is flat in the sense that its width, indicated by the arrow 33" is great relative to the thickness of the metal.

For convenience, the channel 5 will be referred to as oriented in FIG. 1, in which the web 11 lies in a plane 11', or the web contains a straight radial line lying in the plane. The web may therefore be referred to as horizontal, and the flanges 9, 10 as extending vertically, or upright. Other orientations will be referred to hereinbelow. The channel has internal contours 9', 10' (FIG. 1c) between the flanges 9, 10, respectively, and the web.

Essentially, the invention concerns bending the channel 5 on the radius 33, about the axis 33', as noted (see also FIG. 1b). In producing the desired bending effects, force distribution is applied, as represented in FIG. 1, these forces depending on the dimensions of the article or channel 5. These forces are produced by bending processes that are generally known, and which will be referred to at least partially hereinbelow, but the present invention involves new relationship between the forces.

Heretofore, in producing bending of articles, as in the case of the channel 5, stretching forces were applied above the article, during the bending step, and considerable shrinking forces occurred under the article. This resulted in straining the article, which resulted in distorting or tearing of the article, which was at least partially irreversible.

In the exercise of the present invention, a counter force 34 (FIG. 1) (hatched rectangle) is imposed on the outer surface of the flange 9, and a similar force is applied to the inner surface of the flange.

Figure 13:
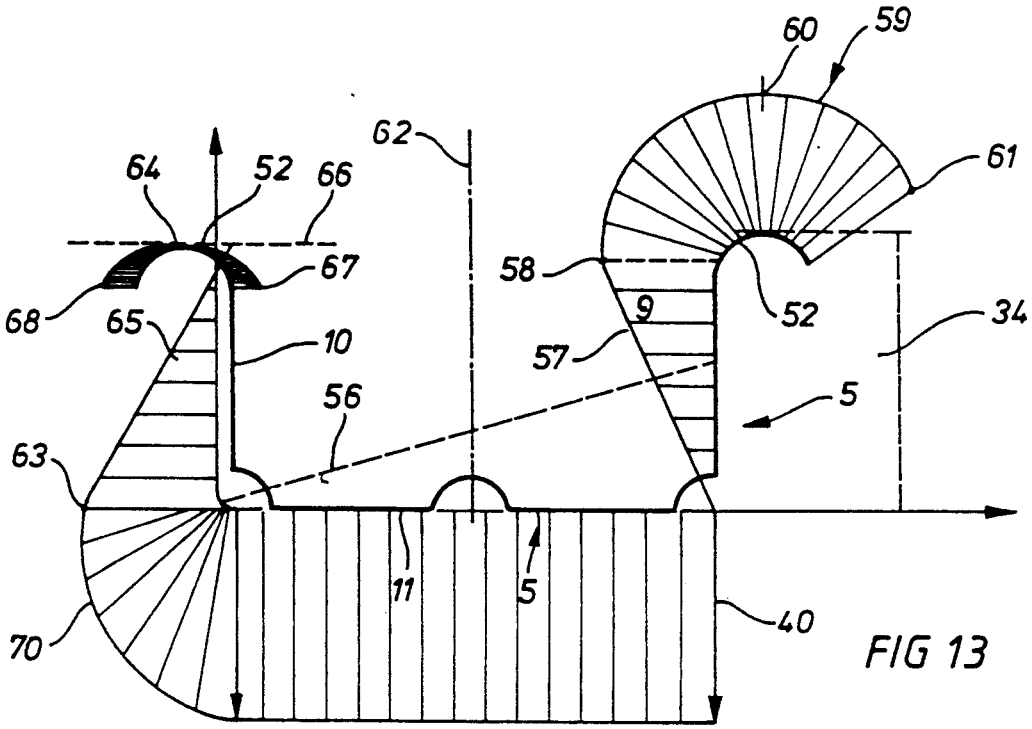
FIG. 13 is a transverse view through the channel, with indication of bending forces applied thereto, relative to a central axis, to produce convex curving according to FIG. 10 or concave curving according to FIG. 11.

In the case of the present invention, rollers 19, 21 (FIG. 2) are utilized, making it possible to apply force to the flange as represented by a power course 56, in FIG. 13. The power course 56 (FIG. 1) extends over the crimp 8 (FIG. 13), but although the pressure roller 6 does not engage the crimp, it produces the power course throughout the extent of the web in radial direction. The desired forces can be produced, eliminating uncontrollable shrinking forces, especially on the underside of the article 5.

In the following step in the rolling or curving operation, reference is made to FIGS. 1, 1c, 1d, and in accordance with bending or shaping the channel on the radius 33, at the axis 33' (FIG. 1b), the greatest pressure is applied on the web 11 at 18, at the right, and the least at point 17, at the left. This pressure is applied by horizontal rollers 4, 6 (FIG. 2), producing the maximum force indicated at 24a at point 18, and this force diminishes in direction across the web, to the left in FIG. 1, where there is very little, or no, force applied, at point 17. These forces are indicated in FIG. 1c the great force at the right being indicated by the heavy arrow 7a, and the light force by the thin arrow 7b. This results in the web 11 being thinned and stretched, mostly at the right hand side, and progressively less toward the left, as shown in FIG. 1c highly exaggerated.

Figure 4:
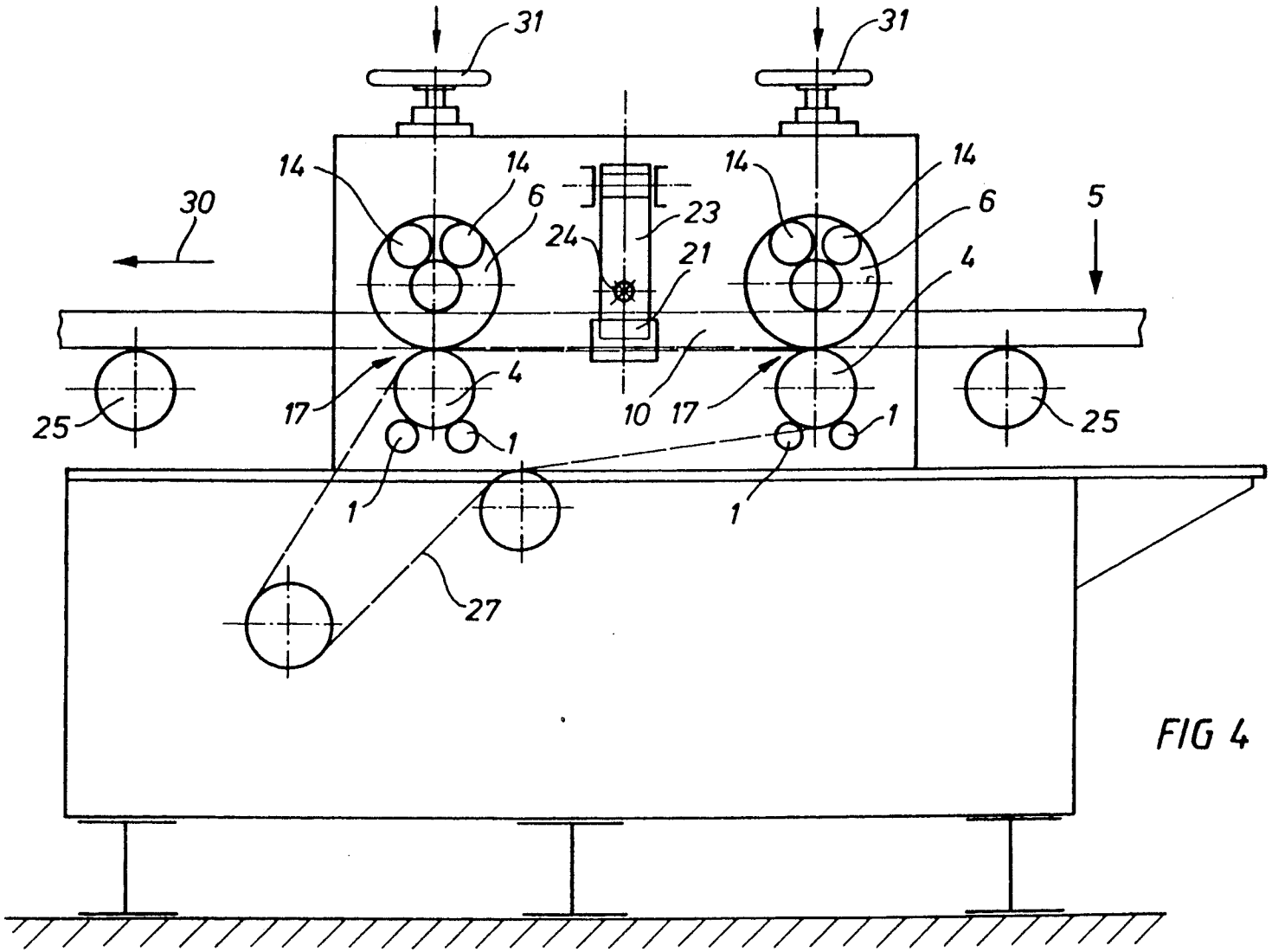
FIG. 4 is side view of the mechanism, partially diagrammatic.

The thinning out or rolling out of the web 11, and flanges 9, 10, may be done alternately, as shown in FIG. 4. In this figure, at each of the stations A' and C' are the rollers 6, 4, spaced along the direction of travel of the channel 5 as indicated by the arrow 30, and between those stations, is station B' where the rollers 19, 21 are positioned, together resulting in a rolling out of the web 11 at station A', then a rolling out of the flange at station B', and then again rolling out of the web at station C'. The portions, i.e., the web and flanges, of the channel may be exposed to the respective rolling out steps in repeated passages. In these steps the folds 52 may be in straight position as shown at 52' in FIG. 16.

The collective effect of these rolling out steps, are represented by the shading in FIG. 1, this total effect producing the circular bending of the channel 5 on the radius 33, about the axis 33'.

This method of the invention, combining bending with roll forming, may be referred to as a press roll bending method, and it avoids distortion of the thin sheet metal channel 5 and attains as a result a stably curved form part.

In FIG. 1c, the rollers 4, 6 are shown, as applying force to the web 11, the roll 6 having rabbet 7 to accommodate the crimp 8 and although the crimp 8 is not engaged, the web and the channel as a whole are bent as stated, i.e., on the radius 33. During the rolling action of the press rollers 6, 4, the rollers 19, 21 (FIG. 2) act on the flanges 9, 10 and thin them out, and the rollers 19, 21 have profile shapes 28 forcing the folds out, i e., toward the axial position. This step is placed alternately with the components for performing the other rolling out steps (FIG. 4), which may be for example placed posterior the first set of rolls 6, 4, in the direction of movement of the channel as indicated by the arrow 30.

The gradual decrease in pressure from the point 18 (FIG. 1) across the web to point 17 produces a gradual and even variation in thickness of the web (FIG. 1c), eliminating distorting and undesired shaping. These forces may be repeated on the various elements with respectively different intensities.

The apparatus of the invention is well adapted to use with other equipment, either before or after, in a succession of steps, such as known machines including three roller bending machines.

Figure 2:
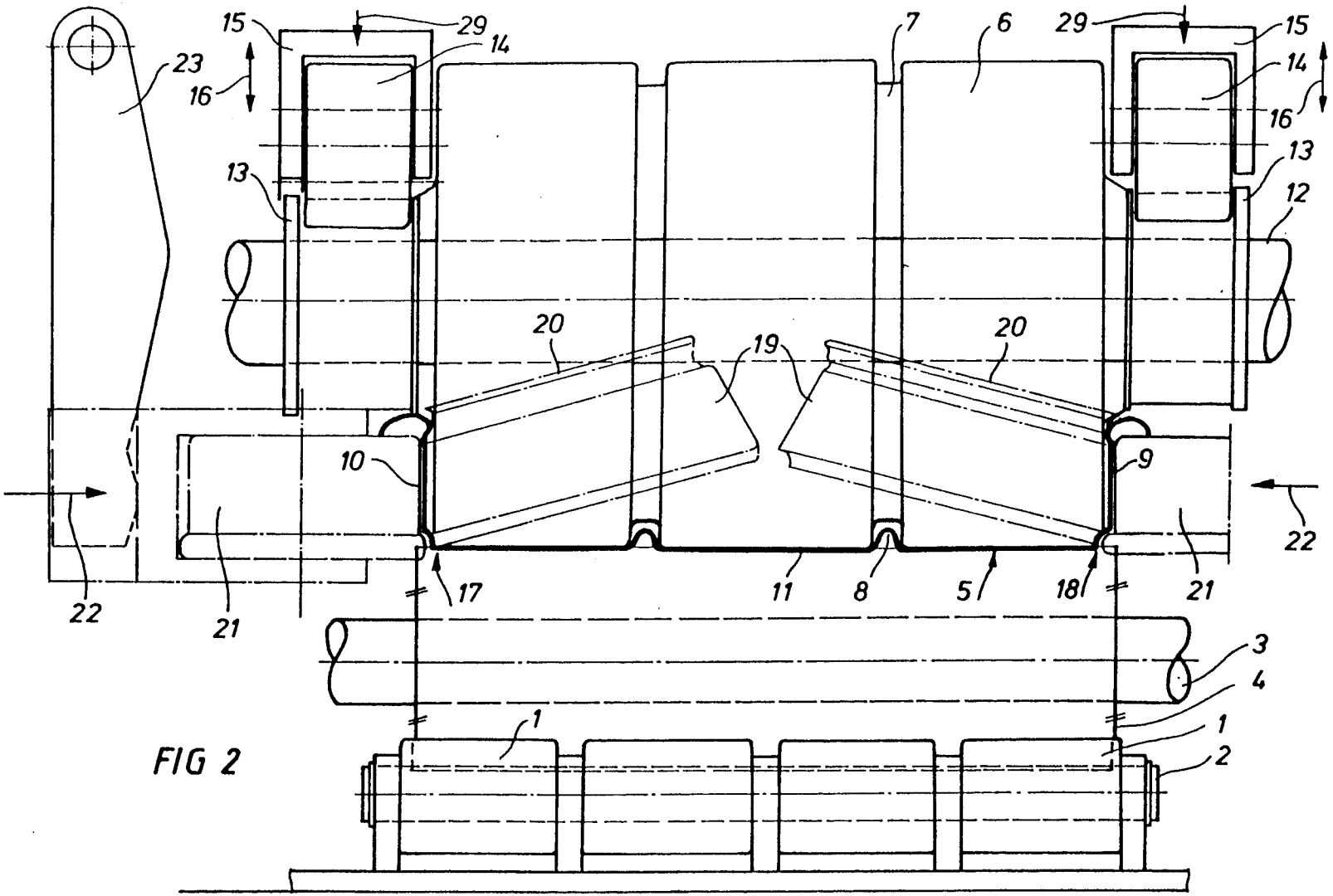
FIG. 2 is a front view of a bending mechanism, and including the channel, and certain press rollers.

In the use of the invention, and particularly in connection with tough, solid materials, vibration may be applied to the web 11 at position 18 (FIG. 1) as indicated at 26b (FIG. 2). This produces an enhanced distribution of pressing force over the web 11.

For applying forces to the flanges 9, 10, are flanking press rollers 19, 21 (FIG. 2) which may also be referred to as profile rollers, are arranged for engaging the inner and outer surfaces of the flanges, respectively.

In the situation considered above, in which the channel is bent on the radius 33, maximum pressing force by the rollers 19, 21 is applied to the flange 9, while at the opposite side, minimum or zero pressure is applied by the corresponding rollers to the flange 10.

The press rollers 19 are provided with contours 28 to accommodate the existing folds 52 on the flanges 9, 10.

The press rollers 6 have shafts 12 supported in plates 13 (FIG. 2) where press rollers 14 are mounted in pressure members 15 (FIGS. 2, 3), and are biased downwardly, for applying pressure, as indicated by the arrows 29. Each member 15 and the corresponding press roller 14 therein are thereby adjustable in the direction of the double headed arrow 16.

For applying pressure on the flanges, e.g. flange 9, the press roller 21 is horizontally movable, the flange re-forming pressure being in the direction of the arrow 22 (FIG. 2). Each press roller 21 is adjustable (FIGS. 2, 4) by an arm 23 to which force is applied from a spindle (not shown) in the direction of the arrow 24 (FIGS. 2, 4).

Figure 3:
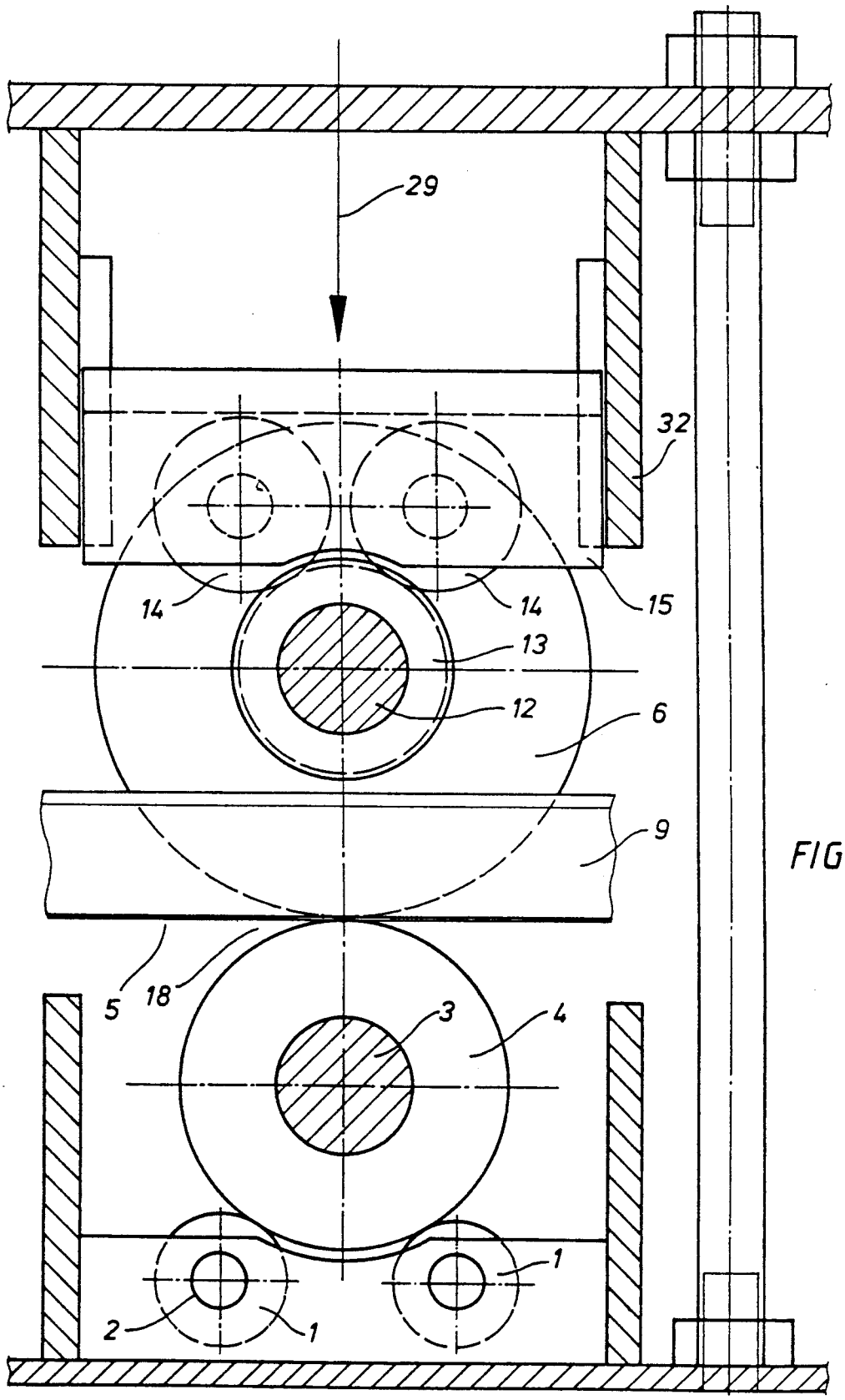
FIG. 3 is a side view of the apparatus, partially in section.

The lower horizontal press rollers 4 ride on support press rollers 1 and are provided with shafts 3, and the rollers 1 with shafts 2. FIG. 3 shows the channel 5 between the rollers 6, 4.

The peripheral speeds of the rollers 4, 6 must be equal, of course, and this may be achieved either by driving the roller 4 alone, as shown in FIG. 4, and allowing the roller 6 to follow it, or by driving both rollers, with both having the same peripheral speeds. Preferably in normal operation, pressure is applied to the press rollers 6, in the direction of the arrows 29 (FIG. 2) through the rollers 14, and the lower press roller 4 is an undriven follower roller.

As shown in FIG. 4, the channel 5 passes in the direction of the arrow 30 over a drive chain 27 driven by a motor, in predetermined steps involving the rollers 6, 4, and the flanking press rollers 21.

It will be noted that, in FIG. 4, the channel 5 is given a rolling out action at the right hand portion of the figure, and then again a further rolling out of the web 11 is provided by the press rollers at the left hand portion of the figure. Preferably idler rollers 25 are provided for supporting the channel at suitable locations.

As the channel 5 is being rolled out, and in the case assumed, the flange 9 (FIG. 2) is thinned and extended, but on the other side of the channel, left side FIG. 2, the roller 21 in this case acts merely as a guide for the flange 10 at that side, which is not extended.

The apparatus is symmetrical, that is, instead of the rollers 4, 6 providing greater pressure at the right hand side (FIG. 2) they may be given maximum pressure at the left hand side instead, with little or no pressure at the right hand side. This is true also of the flanking rollers 19, 21, respectively.

FIG. 4 shows three different re-forming steps, indicated at A',B',C'. In this connection attention is directed FIG. 17. The latter figure includes a rectangle 30*a* which is a diagrammatic illustration of the mechanism shown in FIG. 4. In both that rectangle, and FIG. 4, are designations A', B', C', which represent steps in the bending of the channel. FIG. 17 includes in a horizontal row at the top, letters A, B, C, etc., designating main phases in the overall operation, phase E of this group representing the component 30*a*. FIG. 17 indicates various mechanical components, and represents a relatively long series of steps in carrying out the invention. These steps include bending, straightening out, re-forming, not only the main article, or channel 5, as a whole, but also various elements of the channel including for example the folds 2 on the flanges.

The components of FIG. 4 and represented at 30*a* in FIG. 17, include three steps in the treatment of the channel, namely A', B', C', while the other main phases of FIG. 17 represent additional steps.

At A' is the first bending station relative to the direction of movement of the channel as indicated by the arrow 30, and in this step the web 11 is first press rolled and lightly curved. Thereafter, re-forming of the flanges occurs at B', by means of the rollers 21, and thereafter occurs the finishing press roll step at C'. In this latter step rolls 6, 4 are again provided, in opposed relation.

As referred to above, in addition to these steps, other steps as in main phases A–D, F–I of FIG. 17 may be performed.

FIG. 4 includes the means for applying pressure to the roll 6 referred to above particularly in connection with FIG. 2. FIG. 4 shows worm drives 31 which provide the downward force on the roller 6 this force being indicated by the arrows 29, as referred to above. For applying pressure by the rollers 21 (FIG. 2) an arm 23 is provided which is activated in direction of the arrow 24. Preferably vibration is provided, with adjustable frequencies, on the arm 23 as indicated by the arrow 23*a*, and in the direction of the arrow 24 (FIGS. 2, 4), and on the press roller 6 at the location of the worm drive 31, this latter vibration taking place adjacent point 18 as indicated by the arrow 24*a*.

Figure 5:
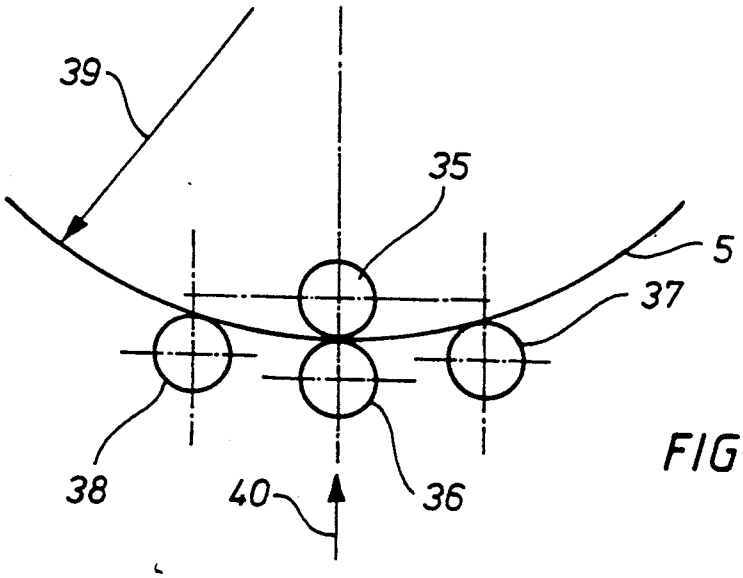
FIG. 5 is a diagrammatic view of a four roller bending mechanism.

FIG. 5 shows a known type of four roller bending machine, by which the contoured article is guided by friction forces between two middle rollers 35, 36. Two follower rollers 37, 38, are provided to provide a curve on the radius 39. In carrying out the method of the invention, a considerable pressing force 40 is impressed upwardly on the middle roller 36, and this together with the follower rollers 37, 38 produce an upwardly concave curve of the channel 5. For producing an upwardly convex curve, an opposite arrangement is used, represented in FIG. 5*a*, with the rollers 37, 38 above the channel. In this arrangement in the roller bending, a press rolling is impressed, so that altogether a press roll bending results, providing tension free curving of heavy, hard to bend, relatively thick-walled channels and other profiles.

Figure 6:
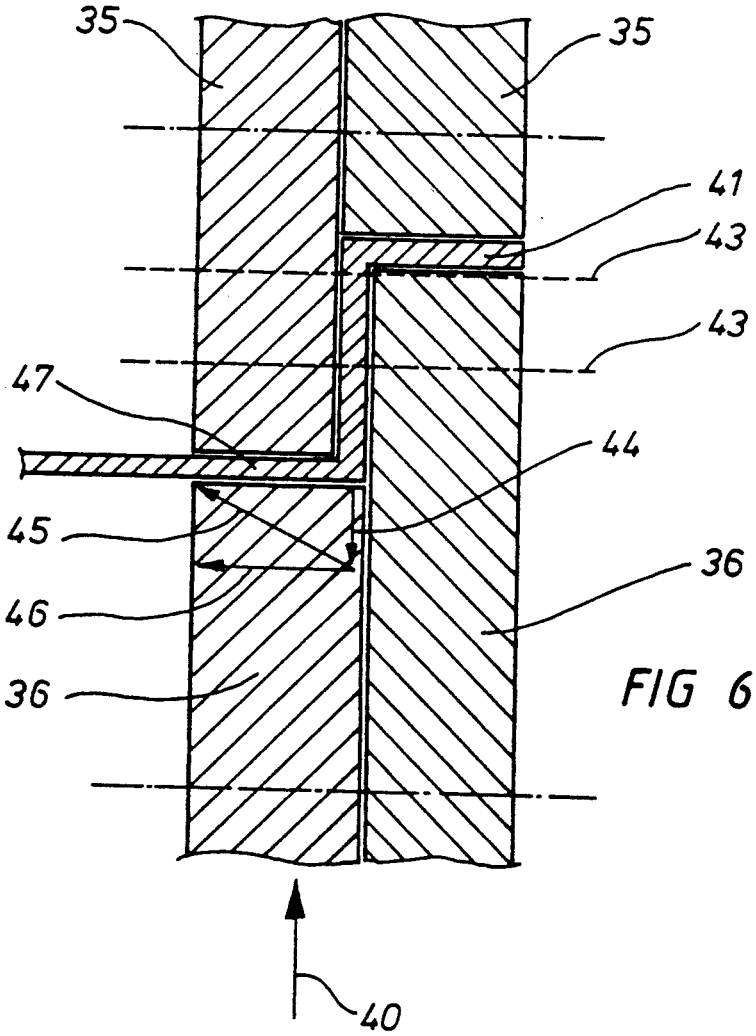
FIG. 6 shows a specific form of press roller to be used with the mechanism of FIG. 5.

FIG. 6 represents the application of a press roller bending method, referred to above. In this arrangement, a Z-profile or shape 41 is placed between the press rollers 35, 36, having an element or segment 41' corresponding with a flange 9 or 10, but without a fold 52, and a relatively large pressing force applied upwardly at 40. Pursuant to this step, a neutral line 42, which is otherwise present in the roller bending process, moves to a harmless region, corresponding to a neutral line 43, that now results. Otherwise effective bending forces 44, 45 are extinguished, resulting in a bending force 46 in the direction of the horizontal shank 47 thus avoiding harmful re-forming of the article.

In roller bending, the shank 47 previously could be bent upwardly, obliquely curved corresponding to the force 45, which is now avoided, since by means of the pressing roll process, uniform stretches arise, whereby re-formings are equalized. A uniform tension over the entire horizontal shank 47 is achieved. The pressing roll process in the present case provides an artificial stretching of the web, or as the case may be, of the horizontal shank 47 so that, so to speak, an artificial bending process ensues, by which, deformations are avoided.

In further realization of the objects of the invention, a roller roll bending step according to FIGS. 1–4 is continued in such manner that in this step, another press roller according to FIGS. 5 and 6 is incorporated. The pressing force 40 (FIG. 6) is uniformly stretched over the total length of the horizontal shank 47, whereby now because of the invention, shapes or profiles 41 that were heretofore difficult to bend, can be bent.

Figure 7:
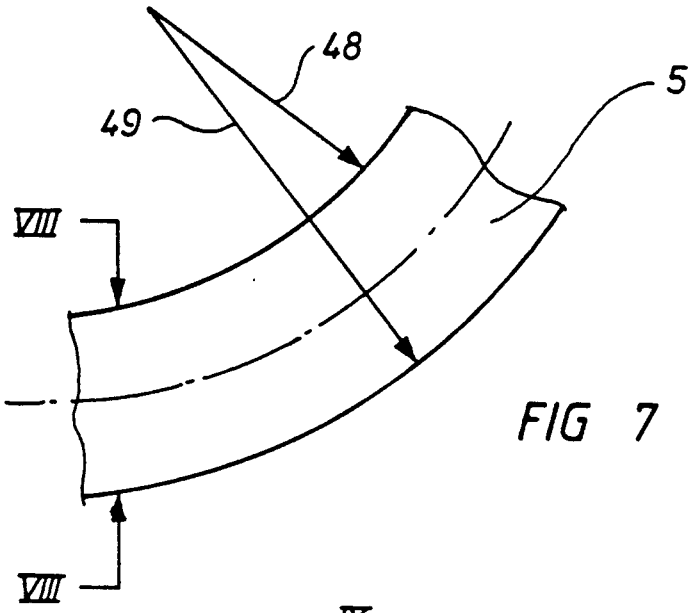
FIG. 7 is a fragmentary and diagrammatic view of the channel to be bent.

The steps of FIGS. 5 and 6 are incorporated and utilized in the steps represented in FIGS. 7–11. In FIG. 7 the channel 5 with pre-bent folds 52, therein, is, according to the present invention, curved on radii 48, 49 in a roller roll bending method, according to FIG. 1. The shading in FIG. 1 represents forces of various values as described above in connection with the rollers 4, 6 and 19, 21. Channels 5 and other shapes of considerable dimensions and proportions, such as of several meters, can be curved or treated.

Figure 8:
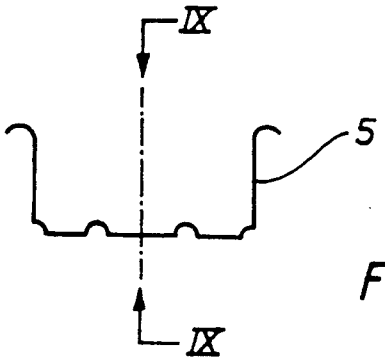
FIG. 8 is a view taken at line VIII—VIII of FIG. 7.

FIG. 8 shows a channel 5 in transverse section, whereby it will be seen that such a channel, with folds 52 is difficult to bend. In the present case, the rollers 19, 21 partially engage the folds 52 and press them out in connection with pre-bending the material on the radius 53 shown in FIG. 10*a*.

Figure 9:
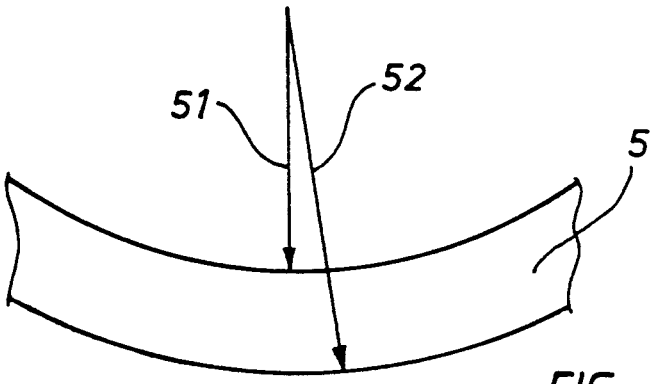
FIG. 9 is a fragmentary and diagrammatic view oriented according to line IX—IX of FIG. 8.

FIG. 9 shows a channel 5 bent on radii 50, 51, in an additional roller process according to FIGS. 5, 6, and as a result of the features of the invention, large thin walled sheet metal pieces, channels 5, and difficult-to-bend sheet metals or articles of tough material, as well as articles having radii 48, 49 of FIG. 7, can be accommodated, as well as those having radii 50, 51 of FIG. 9.

Referring to FIGS. 10–14, and to FIG. 16, these figures illustrate how, in addition to bending and curving the channel 5, as in FIGS. 1–9, the folds 52 are also formed, according to the invention, to increase the stability of the re-formed channel 5. FIG. 16 shows the fold rolled out over rolling pairs 69, 71. As viewed in these figures, the folds 52 are rolled out from the inside, and from the outside, and thereby partially bent up, or the folds 52' are entirely bent up. This is indicated at station B in FIG. 17. After the bending and curving of the fold area in connection with the bending and curving of the web and flanges, as in FIGS. 1–9, the folds are again re-formed hookshaped in the original form as at C in FIG. 17, whereby misshaping or tearing of the folds is avoided.

Figure 14:
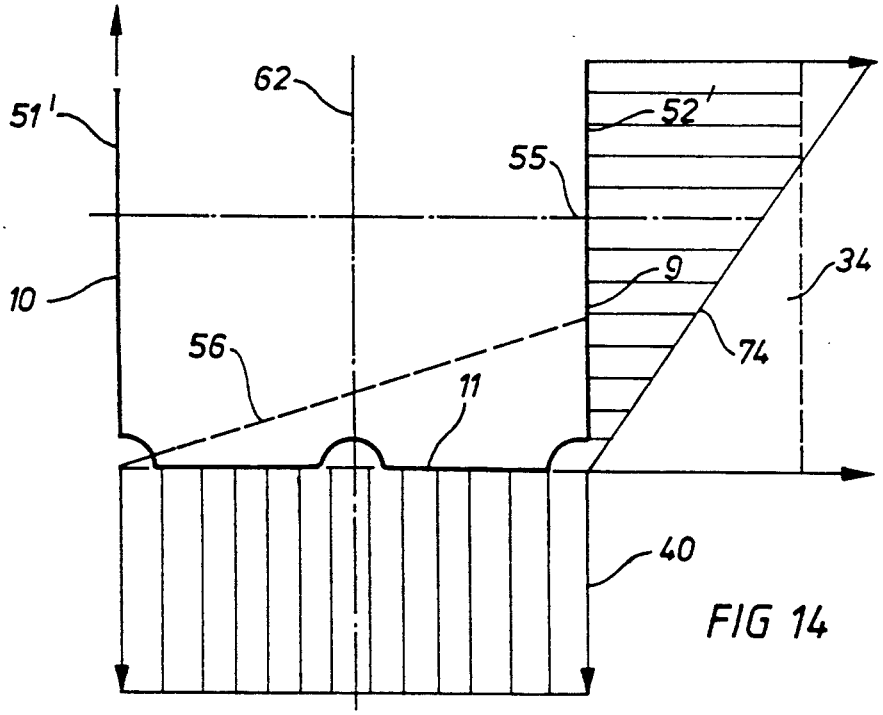
FIG. 14 is a transverse view of the channel, with representation of pressing forces applied, to produce convex re-forming shown in FIG. 10, but with the elements forming the folds bent up into straight position.

As shown in the tension diagrams of FIGS. 13 and 14, a channel 5, according to FIGS. 10 and 11 is produced, where it, with the flanges 9, 10 and folds 52, show a convex curving on the radius 53 (FIG. 10) in the web area 11 or, as in FIG. 11, a concave curving on the radius 54, and at times takes on a curved shape according to FIG. 7.

The curvings on radii 53, 54 are achieved in the web 11 according to FIG. 5 with a roll bending process which is superimposed with a press roll process, whereby additionally the flanges 9 and 10 are rolled in the manner of a pressing roll bending process and also according to FIG. 16, the folds 52 are set under pressing pressure in connection with roller pairs 69, 71. The tension and pressing forces produced by these mechanical instrumentalities are of predetermined values as diagrammatically represented in FIGS. 13 and 14.

FIGS. 12 and 12*a* show a further example of the steps involved in the inventive process. FIG. 12*a* includes the reference line 11', of FIG. 1, namely a horizontal position used as a reference for other elements of the device. A fragment of the channel 5 in conical shape is shown, the web 11 being disposed at an angle 78 to the reference line 11' representing the conical shape. In this conical shape, one flange, 9, lies higher than the other flange, 10. If one visualizes the channel according to FIGS. 12, 12*a* bent in a circular ring on a radius 79 about an axis 80, the result is a cone which narrows toward the axis 80. This conical curving process is achieved with roller pairs arranged to produce the forces represented diagrammatically in FIG. 15. The details of these forces are referred to hereinbelow, but it is pointed out that these forces, or different segments of the forces, are produced by the rollers 19, 21, 69, 71 (FIG. 16). As to the rolls 69, 71, attention is directed to their positioning in FIGS. 16*b*, 16*c* where, as referred to above, the arrows 69', 69'' are disposed in different directions to indicate the direction of imposing the force on the folds 52, as represented in FIGS. 13 and 14.

The diagrams in FIGS. 13, 14, 15 show the course of the pressing force of the successively arranged roller pairs of the mechanisms shown in FIGS. 4, 5, 6, 16, when the previously straight contoured channel 5 is bent and curved in passing the pressing and bend rolling, without illustrating the opening and closing stations for the folds 52, or other guiding rollers.

FIG. 13 indicates the power course 34, 56 which (FIG. 4) is achieved according to the indication of forces of FIG. 1, by the mechanism wherein the channel 5 is bent in a curve according to FIG. 7.

To achieve a convex curving of the channel 5 according to FIG. 10, and referring to FIG. 13, at the right, the flange 9 and the fold 52 are presented corresponding to the tension diagram. For convex curving the forces applied to the flanges are symmetrical relative to the middle axis 62, and the arrangement of forces of FIG. 13 may be reversed, relative to that axis, for treating either of the flanges relative to the other, but for convenience and simplicity the arrangement is shown for only one flange, in FIGS. 13 and 14.

As to the particular forces applied, and referring to the rollers 19, 21 for convex curving (FIG. 13) there is imparted to flange 9 a linearly increasing force 57 emanating from the web 11, this force at point 58 going over the height of the fold 52 in a nonlinear pressing force 59, and which weakly increases up to the vertex 60 to a maximum pressing force and then in the outer region of the fold 52 again falls off weakly, as indicated at point 61.

This tension diagram (FIG. 13) with the linear and nonlinear forces 57, 59 is reached at the flange 9 by means of flanking rollers 19, 21 (FIG. 2) and at the fold 52 by means of contoured roller pairs 69, 71 (FIG. 16), this constituting continuity between the respective press rollers.

At the left of FIG. 13 are shown the flange 10, fold 52' and web 11, a tension arrangement, for concavely curving the channel 5 as in FIG. 11, and if it were to be bent in the opposite direction, the same tension diagram would apply to flange 9 instead of flange 10.

In shaping the flange 10, in the present assumed direction of curving, a maximum pressing force 63 (FIG. 13, left) is applied which, corresponding linearly to the pressing force 65, falls off up to a 0 point 64 of 0 line 66 at the fold 52.

On both sides of the fold 52 (FIG. 13, left) by means of the varyingly enlisted and potentially rotational roller pairs 69, 71 (FIG. 16) an outwardly and inwardly lightly increasing pressing force 67, 68 (FIG. 13) is applied.

This step in bending the folds 52 is correlated with other steps represented in FIG. 2 and at station F in FIG. 17 where press rollers 19, 21 in the curving area between the flange and the web 11, a curved linear, lightly increasing force 70 (FIG. 13) is applied.

Furthermore, for convex curving in a further station, according to FIG. 5, in reverse bending direction, as a station A in FIG. 17, there is imparted to the web 11 in connection with a press roll bending process, an additional pressing force 40 (FIGS. 5, 6), in order to concavely curve the web 11.

For convex curving, the bending direction is reversed relative to that of FIG. 5.

As represented in the tension diagram of FIG. 13, for achieving a convex or concave additional curving, of FIGS. 10 or 11, the folds 52, which originally as in FIG. 2 are represented as a ball or hook fold, are easily bent up as indicated at 52' FIG. 16.

The rollers 69, 71 (FIG. 16) have peripheral contour surfaces 72, 73 for producing the courses at the folds 52 as indicated in FIG. 13, either the left or the right, according to the intended direction of curving of the channel. This is done by swinging the rollers 69, 71 relative to each other, as shown in FIGS. 16*b*, 16*c*, referred to above, for producing the forces at the intended points. The rollers 69, 71 need not have complex contour shapes.

In another station, associated with the apparatus as arranged in FIG. 4, and by means of rollers not shown here, rollers such as 19, 21 (FIG. 2) with peripheral surfaces of appropriate contour shapes, for beading, the original semicircular folds 52 are beaded straight to appropriate folds 52' as indicated in dot-dash line in FIG. 16, and station D in FIG. 17.

The channel 5, with such folds 52' in straight shape, extending from the flanges (FIG. 14), can similarly be concavely or convexly curved. As represented in FIG. 14, by means of flanking contoured press rollers, similar to rollers 19, 21 of FIG. 2, and in a posterior station, relative to FIG. 4, i.e., to the left, after the beading process, a pressing force 74 that linearly increases from the web 11 is applied to the corresponding flange (9) this force continuing throughout the extent of the flange and the fold 52'.

For concave curving, the pressing forces 74, 40 are reversed relative to that of FIG. 14. The curving step in applying the pressing forces 34, 56 (FIGS. 13 and 14) is oriented according to bending of the channel as viewed overhead, and in a station anterior to or posterior to the stations of FIG. 4, this being represented at station F in FIG. 17.

After the convex or concave bending of the channel 5, as in FIGS. 13 and 14, the partially bent fold 52 or the totally bent fold 52', arranged in a closing station, at the far left of FIG. 17, at the end of the passage of the channel, is bent somewhat back into the original form, as in FIG. 15. In comparing the force diagrams of FIG. 13 and FIG. 14, it will be observed that both shaping of the folds 52, whether partially or totally bent, have their respective advantages. From the right side of FIG. 13, a feature observed that if the fold 52 is not bent very much, then in the vertex 60, a pressing force works, which is less than the pressing force according to FIG. 14 at the end of the fold 52', that is, after the bending of the folds, relatively high pressure forces are applied, thereby eliminating rollers 69, 71.

The partial or complete bending of the folds 52 in several successively related bending stations is produced by arranging the roller pairs 69, 71 (FIG. 16) so that for example, in such a first station, related anteriorly through the arrangement, a partial bending of the folds 52 according to FIG. 16 results, whereafter at the web 11, in a further bending station, related in the series of steps, a pressing force 40 (FIG. 5) is applied, and a form body according to FIG. 10 or FIG. 11 is produced, and also in a third station, related to the steps at a posterior position, the fold 52 is again closed with the corresponding form rollers, so that the fold 52 attains its original shape.

A similarly constructive solution is also reached by an evenly rolled out fold 52' so that first the straightened channel part with folds runs through the first station, where the fold is rolled out straight as at 52' (FIG. 14), and then in a third station, the channel with the flanges 9, 10 is rolled out with the pressing forces 40, 74 (FIG. 13) to a bowshaped body according to FIG. 10 or FIG. 11 as performed in FIG. 4, and later in a posterior station the bent fold is again closed with corresponding form rollers.

Reference is now made to FIG. 15 illustrating the means for forming a conical body according to FIGS. 12, 12*a*, and the diagram of forces involved therein.

Three bending radii are shown (FIG. 15), 75, 76, 77, and this figure also shows the reference line 11' in this case representing the horizontal, and the angle 78, referred to above in connection with FIG. 12*a*. The forces to be applied to the folds 52 are not represented in FIG. 15, because a process corresponding to FIG. 13 is utilized.

For the conical re-forming of the channel (FIG. 15), at the right hand fold 52, a radius 77 is defined, where a 0 point 79 is present, leading from which the pressing force increases in the form of a linear curve 80 to a vertex 81, which lies in the plane of the web 11. In order to be able to roll out the radius in the passage between flange 9 and the web 11, a pressing force corresponding to the bend curve 52 is provided, which stretches or extends to a point 83 in the plane of the flange 9. It is important, that the pressing force 84 exists, and that from the position 83 outward, the pressing force 84, in the form of a linear curve 85, is increased to position 86, where the pressing force 87 is maximum.

At the passage between the web 11 and the flange 10, the pressing force again follows the radius 76, that is, it follows the curve forming pressing force 88, in order to extend up to the vertex 89, which lies in the plane of the web 11.

With this device, it is now entirely essential, that the conical body is produced without misshaping the flanges 9, 10 in the bending, that from the point 89, the pressing force linearly declines up to the point 90, throughout the extent of the flange 10, and thus allows the linear curve corresponding to radius 75. If the pressing force 91 were allowed to increase linearly, instead of allowing it to decrease, then the flange 10 would be curved uncontrollably. Concerning this last feature, it is important that an X-Z axis be provided, and out of this plane the position is determined, in that at the inner radius 77, there is a 0 point 79, and the farther one goes from this 0 point 79 out of the X-Z axis, all the more must the channel be stretched and rolled out, in order to maintain a corresponding re-forming step.

Thus with the radius 76, that is, the largest radius, the largest re-forming is also necessary, and with the radius 75, corresponding to the smaller radius, a smaller re-forming is necessary, from which decreases of the pressing force in the shape of a linear curve 91 result.

In the device of the invention, a situation exists wherein by means of varying application of pressing force at the form rollers, a shape (channel) can be produced to different geometrical proportions.

In the exercise of the invention, the original cross section of the contoured channel 5, as in FIG. 15, in all the bending processes and after the passage therethrough (i.e., through the apparatus of FIG. 4) always remains true to form, as well as the ball or hook folds 52 or as the case may be, can be re-formed so that the formed parts without further touch up can be connected with each other (FIGS. 4*a*, 4*b*), whereby no essential material weakening or torn locations and deformations in the shape of wrinkles occur.

Pieces or lengths 5' (FIGS. 4*a*, 4*b*) of a channel 5, can be interlocked side-by-side, with the respective folds 52 interconnected, and interlocking. These lengths form a composite member or device 93, which may be used as a cover or lid. Such a cover may be made of substantially any size and geometrical shape, as indicated by an outline 94.

Should it prove that cross sections as represented in the region of the folds, or otherwise closed profile cross section, can only be attained with difficulty or not at all with form rollers, then in the further exercise of the invention, the folds or closed channel cross sections (profiles) would be partially or entirely opened, with more or less smoothed out crimps that were introduced, or in bending, wrinkles that were produced.

In the use of the present invention, it is for the first time possible that even complex contour shapes, such as folds, can be maintained true to form, so that even after the production of desired spherically re-formed metal shapes (channel, profiles), they can effortlessly be laid next to one another and bound together at the newly developed folds. In realizing this feature of the invention, desired geometrical forms for lids or the like can be produced in close connection. In the exercise of the invention also, curves with straight edges are also producible according to the arrangement of the press roll bending rollers and the contour rollers relative to one another.

From the foregoing, important features and advantages of the invention may be summarized.

Various shapes, including U-shaped articles can be bent. Such shapes can be bent vertically, relative to vertical flanges, to provide either a concave or a convex shape. Such U-shaped articles can in addition to being bent vertically, can additionally be circularly bent, the resulting articles having shapes as produced by both kinds of bending. Cone shaped articles can be produced. Original contours may be vitiated, and again restored, to maintain the original main shape of the original article. Original contours and shapes are produced by contoured roller pairs. Heretofore in producing various curves and shapes, shortening of the articles was caused by crimps, but in the case of the present invention such crimps are avoided. As a result of avoiding crimps, original desired stiffness in the article is maintained. A shape such as a channel can be given a curved shape by means of linearly increasing pressure on the web and rolling out a flanking flange, eliminating rolling out of possible previous contourings or folds. A curved profile may be provided in a channel having folds in the extended edges of the flanges, without requiring the folds to be rolled out. Such a channel may be bent convexly or concavely, in an operation in which the folds are bent up only partially or entirely, and later re-formed again in their original form. Curved folds can be rolled out, without being deformed or torn.

The article can be curved by imposing forces of different values at different locations to produce thinning out and stretching of certain areas relative to other areas. Contours such as folds, can be produced in different directions and shapes by utilizing opposed rollers and swinging the rollers relative to each other. Shaping or contouring steps for producing specifically different shapes, can be arranged alternately, in progression along the length of the article. Flanges of a channel can be rolled out in successive stages. Relatively large volume profiles or shapes with small cross sections can be bent without deformation, and asymmetrical cross sections can be bent in material that is relatively thick-walled and difficult to bend, without having to fear deformation. Vibrations of various frequencies, are applied to the article, in the bending steps, expediting the bending action.

Forces are applied through opposed rollers acting on elements therebetween, with expeditious rolling and stretching effect.

A plurality of the articles, channels, are provided with folds on the free edges of the flanges, enabling channel pieces to be fitted side by side, the folds are of respectively different dimensions, enabling the folds on adjacent flanges to be interlocked, to provide a compound article made up of the channel pieces. Such articles may be made of various and complex geometrical forms and shapes, to form covers or lids.

I claim:

1. Mechanism for curve bending a shaped sheet metal article moving along a longitudinal line, especially of either a line pressed thin aluminum profile or of a roll re-formed thin aluminum or steel sheet with a web and side flanges, including a feeder table having a top surface extending longitudinally for receiving the sheet metal article and oriented relative to an axis perpendicular to said top surface wherein, lower stationary horizontal press rollers (4) and upper vertically adjustable horizontal press rollers (6) are provided for engaging opposed surfaces of the web (11) of the sheet metal article (5), and flanking press rollers (19, 21) separate from the horizontal press rollers are arranged for engaging opposed surfaces of the flanges (9, 10) of the sheet metal article, the flanking press rollers (19, 21) being situated downstream from the lower stationary horizontal press rollers (4) and upper vertically adjustable horizontal press rollers (6), the flanking press rollers cooperating with one another and the press rollers cooperating with one another so as to progressively thin the web and flanges causing the sheet metal article to curve about the axis, and the horizontal and flanking press rollers (4, 6, 19, 21) are provided with contourings.

2. A mechanism according to claim 1 wherein, support press rollers (1) are included, and the lower press rollers (4) engage support press rollers (1) on their peripheral surfaces, and are supported thereby.

3. A mechanism according to claim 1 wherein, the horizontal press rollers (6) include shafts (12) at their ends, the mechanism includes pressure rollers (14) mounted in supports (15) engagable with the shafts, and thereby the pressure rollers (14) being vertically adjustable by means of a worm driver (31) for varying pressure applied by the pressure rollers on the press rollers.

4. A mechanism according to claim 1 wherein, the side flanges have inner sides facing toward each other, and outer sides facing away from each other, the flanking press rollers include a pair related to each side flange, and each pair includes an inner roller (19) and an outer roller (21), the inner rollers (19) are arranged stationarily in location and the outer rollers (21) are arranged for adjusting movement toward and from the respective side flanges, and the mechanism includes means for so moving the outer rollers (21).

5. A mechanism according to claim 1 and including, a drive chain (27) for driving the lower horizontal press rollers (4) and a motor for driving the drive chain.

6. A mechanism according to claim 1 and including, bending roller pairs (71, 69) arranged selectively with the stationary and adjustable horizontal press rollers (6, 4), said bending roller pairs (71, 69) for opening of folds (52) and for rolling out of the folds, a plurality of roller pairs for closing the folds, and for curve bending the profile part about said radius, additional horizontal press rollers and flanking press rollers for curve bending the sheet metal article about said radius, posterior to the bending roller pairs along said longitudinal line.

7. A method of curve bending a shaped sheet metal article, especially of either a line pressed thin aluminum profile or of a roll re-formed thin aluminum or steel with a web and side flanges, on a feeder table having a top surface extending longitudinally and oriented relative to an axis extending perpendicular to said top surface, said method including the steps, rolling the web (11) of the sheet metal article (5) with the web (11) between two horizontal press rollers (4, 6), by applying maximum roll pressure of the press rollers against the web at a first side of the article, while maintaining the press rollers pressureless against the web at a second side of the article, and thereby thinning and stretching the web at said first side and thinning and stretching it less, progressively, toward said second side, and consequently curving the web on a radius extending from said axis, and utilizing two flanking press rollers (19, 21) separate from and downstream of the horizontal press rollers and applying pressure thereby to opposed surfaces of the side flanges (9) at said first side and thereby thinning and stretching that flange and thereby curving it on said radius and complementary to the curve of the web.

8. A method according to claim 7 and including the step, in connection with the bending process, providing a plurality of additional horizontal press rollers (4, 6), spaced longitudinally and thereby producing a variable maximum pressing pressure on said first side of the sheet metal article (5), and maintaining the press rollers at said second side pressureless.

9. A method according to claim 7 and including the step, utilizing known core roller bending machines in succession with the horizontal press rollers (4, 6) and the flanking press rollers (19, 21), selectively before or after the latter.

10. A method according to claim 7 and including the step, arranging the sheet metal article (5) with its web and/or flange between two horizontal press rollers (35, 36) and in the manner of a four roller bending machine also between further bending rollers (37, 38).

11. A method according to claim 7 and including the step, providing vibrations on the upper horizontal press rollers (6) on the side of the maximum pressing pressure.

12. A method according to claim 7 and including the step, providing vibrations on flanking press roller (21).

13. A method according to claim 7 and including the steps, partially bending folds (52) to semicircular form in the flanges (9, 10), and convexly curving the article (5) about said radius, emanating alternately left and right relative to the web (11), applying linearly pressing pressure, and applying linearly running pressing forces (59) to the folds.

14. A method according to claim 7 and including the steps, partially bending folds (52) to semicircular form in the flanges (9, 10), and concavely curving of the article (5) about said radius, emanating alternately left and right from the folds, and at the folds (52) in the outer and inner regions applying linearly increasing pressing forces (65, 67, 68), and progressing to the web (11), applying linearly increasing curving pressing forces (70), and applying a uniformly running pressing force (40) along the web (11).

15. A method according to claim 7 and including the steps, bending folds (52) rectilinearly to the position of lengthening the flanges (9, 10), and convexly or concavely curving the article (5) about said axis, and at the folds (52), emanating alternately left and right from the web (11) applying linearly increasing/decreasing pressing forces (74) together with applying a uniform pressing force 40) at the mid portion of the web (11).

16. A method according to claim 7 and including the steps, conically curving the article (5) in the web (11) by:

applying a linearly increasing force (85) in the direction of the bending, applying linearly increasing forces (82, 88) to the areas leading from the flanges (9, 10) to the web, and applying linearly decreasing pressing forces (80, 91) in the direction toward the folds (52).

* * * * *